US006942754B2

(12) United States Patent
Izumi et al.

(10) Patent No.: US 6,942,754 B2
(45) Date of Patent: Sep. 13, 2005

(54) PROCESS FOR PRODUCING XYLOOLIGOSACCHARIDE FROM LIGNOCELLULOSE PULP

(75) Inventors: Yoshiya Izumi, Tokyo (JP); Jun Sugiura, Kawasaki (JP); Hitoshi Kagawa, Yokohama (JP); Naoya Azumi, Chiba (JP)

(73) Assignee: Oji Paper Co., Ltd., Tokyo (JP)

( * ) Notice: Subject to any disclaimer, the term of this patent is extended or adjusted under 35 U.S.C. 154(b) by 0 days.

(21) Appl. No.: 10/126,944

(22) Filed: Apr. 22, 2002

(65) Prior Publication Data

US 2002/0195213 A1 Dec. 26, 2002

Related U.S. Application Data

(63) Continuation-in-part of application No. 09/533,887, filed on Mar. 22, 2000, now abandoned.

(30) Foreign Application Priority Data

Mar. 23, 1999 (JP) ..... 11-077549
Aug. 13, 1999 (JP) ..... 11-229068

(51) Int. Cl.[7] ..... D21H 11/20

(52) U.S. Cl. ..... 162/37; 162/42; 162/43; 162/65; 162/72; 162/82; 210/651; 210/652

(58) Field of Search ..... 162/29, 30.1, 41–45, 162/65, 72, 16, 37, 82; 435/277, 278, 227, 228; 127/37; 210/651, 652, 701, 702; 536/1, 1.11; 426/52, 53, 54

(56) References Cited

U.S. PATENT DOCUMENTS

| | | | | |
|---|---|---|---|---|
| 4,908,311 | A | 3/1990 | Sasaki et al. | 435/101 |
| 4,946,556 | A | 8/1990 | Prough | 162/60 |
| 5,179,021 | A | 1/1993 | Du Manoir et al. | 435/278 |
| 5,551,515 | A | 9/1996 | Fodge et al. | 435/281 |
| 5,618,386 | A | 4/1997 | Arbeloa et al. | 162/72 |
| 5,723,328 | A | 3/1998 | Dalboege et al. | 435/209 |
| 5,736,384 | A | 4/1998 | Fukunaga et al. | 435/278 |
| 5,766,478 | A | 6/1998 | Smith et al. | 210/651 |

FOREIGN PATENT DOCUMENTS

| | | |
|---|---|---|
| EP | 0 265 970 A2 | 5/1988 |
| EP | 0 301 522 A2 | 2/1989 |
| EP | 0395792 A2 | 11/1990 |
| EP | 0 395 792 A | 11/1990 |
| EP | 0408803 A1 | 1/1991 |
| JP | 02-286695 A | 11/1990 |
| JP | 04272289 | 9/1992 |
| WO | WO 88/03190 | 5/1988 |
| WO | WO 91/02840 | 3/1991 |
| WO | WO 9102840 | 3/1991 |
| WO | WO 9420672 | 9/1994 |
| WO | WO 98/15581 | 4/1998 |
| WO | WO 9815581 | 4/1998 |

OTHER PUBLICATIONS

Paice et al, "Viscosity–Enhancing Bleaching of Hardwood Kraft Pulp with Xylanase From a Cloned Gene", Biotech & Bioeng, vol. 32, pp. 235–239 (1988).

Viikari, et al., "Bleaching with Enzymes", Proceedings from the Int'l Conf on Biotech in the Pulp and Paper Ind: Advances in Applied and Fundamentals Research, pp. 67–69 (1986).

*Primary Examiner*—Steve Alvo
(74) *Attorney, Agent, or Firm*—Arent Fox

(57) ABSTRACT

Xylooligosaccharide is produced from a lignocellulose pulp by enzyme-treating a lignocellulose pulp with hemicellulase, filtering the resultant reaction mixture to separate a liquid fraction from the enzyme-treated pulp, subjecting the separated liquid fraction to a permeation treatment through a separation membrane to separate a non-permeated fraction containing xylooligosaccharide-lignin complex with an increased concentration from a permeated fraction, collecting the non-permeated fraction, and separating and recovering xylooligosaccharide from the collected non-permeated fraction.

9 Claims, 3 Drawing Sheets

PROCESS FOR PRODUCING XYLOOLIGOSACCHARIDE FROM LIGNOCELLULOSE PULP

CROSS-REFERENCE TO RELATED APPLICATION

This application is a continuation-in-part of application Ser. No. 09/533,887, filed Mar. 22, 2000, and now abandoned.

BACKGROUND OF THE INVENTION

1. Field of the Invention

The present invention relates to a process for producing xylooligosaccharide from a lignocellulose pulp.

2. Description of the Related Art

It is known that oligosaccharides are useful as a saccharide material for lactic acid bacteria-containing beverages and chocolate-containing food which are classified as specific healthful foods having an effect of promoting the selective propagation of lactic acid bacteria and of contributing to keeping the stomach and intestines in good condition, and are utilized as emulsifying agents and skin-moisturizing agents for drugs and sanitary materials. Also, the oligosaccharides are used as additives not only for foods for human beings but also for feed for livestock.

Generally, almost all of the oligosaccharides used in the specific healthful goods have an intestine-controlling activity for decreasing the colon bacteria which are undesirable bacteria in the intestines and clostridium bacteria which are putrefaction fermentation bacteria in the intestines and on the contrary for increasing bifid bacteria which are known as desirable bacteria in the intestines. For example, the mold bran of wheat are polysaccharides comprising hemicellulose having, as a backbone drum, xylane groups, are scont-decomposible vegetable fibers, and are used as an additive for food having intestine-controlling activity.

The intestine-controlling activity of the wheat mold bran is assumed to be derived from xylooligosaccharides produced by decomposing the wheat mold bran by the intestinal bacteria in the intestine. Also, it is assumed that the xylooligosaccharides derived from the wheat mold bran promotes the selective increase of the bifid bacteria which are desirable bacteria in the intestines, and also causes the colon bacteria which are undesirable bacteria in the intestines to be decreased. The colon bacteria and the putrefaction fermentation bacteria in the intestines are known to produce carcinogenic substance which then are increased in the intestines, and thus to keep good health over a long period it is important that the numbers of the colon bacteria and the putrefaction fermentation bacteria are decreased in the intestine.

It is assumed that the longer the chain length of the xylooligosaccharides, the higher the promotion effect on the selective propagation of the xylooligosaccharides ingested by the human body. Particularly, the xylooligosaccharides in the form of tri-or more-mers contribute the selective propagation of the bacteria.

The xylooligosaccharides available in trade at the present time, are produced from a material made from herbages, for example, wheat mold bran or corn-cob. In the material made from the herbages, the xylan backborn chain has branched side chains made from saccharide other than xylan, for example, glucuronic acid. When an oligosaccharide consisting of only the xylan is produced from the xylan having many side chains, only oligosaccharide having a relatively low degree of polymerization can be produced. At the present, in almost all of the xylooligosaccharides now in trade, the oligosaccharides from which the xylooligosaccharides are formed are in the form of dimers. Accordingly, the xylooligosaccharides having a higher degree of polymerization than that the dimer are strongly demanded.

The xylooligosaccharide is produced from xylan which is one of the principal components for forming plants. As a xylan in the form of a straight chain and consisting of xylose only, stalks of esparto and tabacco are known. As xylan in the form applicable for industry, arabinoxylan contained in wheat mold bran and corn cob which are produced as a by-product in the corn production, glucuronoarabinoxylan contained in softwoods and glucuronoxylan contained in hardwoods are known. In the saccharides contained in these xylans applicable for industry, arabinose, glucuronic acid, 4-O-methyl glucuronic acid, glucose and galactose are contained in addition to the xylose. The proportions of the xylose and the other saccharides are variable depending on the type of the plants.

Japanese Patent No. 146,374 discloses a method of producing xylan in which bagasse and other grasses, leguminous plants, and linaceace plants which contain pentosan in a high content are digested in the presence of an organic acid such as acetic acid under high pressure, to make the scant water-soluble protosan contained in the starting material soluble in water and to make the tissues other than fibrovascular bundles weak and brittle; the digested material is ground and washed; and the resultant fiber bundle is subjected to a known pulping procedure by, for example, soda method, alkali sulfite method or sulfate salt method, to separate and collect pentosan from the pulped material.

The xylose is contained in a high content in wood, and the content of xylose based on the total weight of the wood is about 6 to 10% in softwood, and about 20% in hardwood, and thus the xylose is an important component of the wood. (Migita Nobuhiko et al. "Wood Chemistry" published by Kyoritsu Shuppan, page 73 (1968)). It is known that xylan is extracted from wood and is used to produce xylooligosaccharide, xylose, and xylitol, in practice.

At the present time, the pulp is produced mainly from wood chips by chemical treatment or mechanical treatment. When the pulp is produced and collected from the wood. Lignocellulose material, particularly the residual component of the wood chips after the pulp comprising cellulose collected from the wood chips mainly comprises lignin and hemicellulose which are contained in the waste liquid from the pulp-producing procedure.

Various technologies of isolating specific components from the waste liquid of the pulp-producing procedure and utilizing the isolated components for woods or food additives have been used in practice. In an old technology, vanillin had been produced by oxidizing a waste liquid from a sulfite pulp-producing procedure with air or oxygen in an alkaline reaction system at a temperature of about 160° C.

Also, Japanese Examined Patent Publication No. 43-731 discloses a method of producing xylose from hemicellulose contained in a waste liquid delivered from a pulping procedure by a pre-hydrolysis method in a kraft pulp-production.

Also, production of a seasoning matter has been practically carried out by preparing yeast by using, as a culture medium, saccharide contained in a large amount in the waste liquid delivered from the sulfite pulp producing procedure, and collecting the seasoning matter such as nucleic acid from the yeast per se or yeast-containing composition. Further, Japanese Unexamined Patent Publication No.

51-101,193 discloses a method of producing a protein from the waste liquid discharged from the sulfite pulp-producing procedure, and Japanese Unexamined Patent Publication No. 56-144,742 discloses a method of producing ethyl alcohol from the waste liquid from the sulfite pulp-producing procedure.

L. Viikari et al., Biotechnol, Pulp Paper Ind. (Stockholm) pp 67 to 69 (1986) reports when a pulp is treated with xylanase and the whiteness of the pulp is improved by this treatment. Also, Mora et al. report, in F. Mora et al., J. Wood Chem. Technol., Vol. 6, pp 147–165 (1986), that the mechanical strength of pulp can be enhanced by treating the pulp with xylanase. This report further discloses that a filtrate of a reaction mixture produced by treating a kraft pulp of birch wood with xylanase contains, xylose and xylooligosaccharides including di- to octa-mers of xylose. Further, D. J. Senior et al., Biotechol, Lett., vol. 10, pp 907–912 (1922) discloses that a filtrate obtained from a reaction mixture prepared by treating a kraft pulp of aspen wood with xylanase contains xylose and xylooligosaccharides. However, the above-mentioned reports are quite silent as to a recovery of xylooligosaccharides from a filtrate of an enzyme treatment reaction mixture.

As a method of producing xylooligosacccharides, U.S. Pat. No. 4,181,796 (corresponding to Japanese Unexamined Patent Publication No. 53-35,005) discloses a method in which a botanical material is treated, together with acetic acid, with saturated steam at a temperature of from 160° C. to 230° C. under pressure, and water-extractable xylan and xylan fragments are separated from monosaccharide and other impurities. In accordance with this method, the xylan and xylan fragments can be refined by a treatment with an OH-type strong basic ion-exchange resin and by an ultrafiltration with a high efficiency.

Japanese Unexamined Patent Publication No. 61-242,592 discloses a biochemical method in which xylan is treated with xylanase produced by microorganism in Bacillus group, and xylooligosaccharides are produced from a filtrate prepared from the reaction mixture of the xylanase treatment, by collecting a clear filtrate from the reaction mixture after the xylanase is heat-deactivated, and concentrating the clear filtrate to provide a syrup of xylooligosaccharide, and optionally freeze-drying the syrup to provide a powder of xylooligosaccharide Also, according to Japanese Unexamined Patent Publication No. 63-112,979, in a method of recovering xylooligosaccharide from a filtrate of a reaction mixture prepared by treating hardwood xylan with xylanase derived from *Trichoderma,* the filtrate is decolored by activated carbon, the activated carbon is removed from the filtrate by using a filter press, the saccharide absorbed in the activated carbon is recovered by using a 15% ethanol, the recovered saccharide is treated with an ion-exchange resins (trademark: AMBERLITE IR-120B and AMBERLITE IR-410, to remove salts, and then is concentrated by a reverse osmosis membrane to obtain xylooligosaccharide containing xylobiose in a high content.

These publications are, however, quite silent as to the recovery and refining of xylooligosaccharides from a filtrate prepared from a reaction mixture in which a chemical pulp is treated with hemicellulase.

When the xylooligosaccharide contained in the filtrate of the reaction mixture in which the pulp is treated with hemicellulase, is recovered and refined by the method disclosed in Japanese Unexamined Patent Publication No. 63-112,979, the necessary cost is too high and thus this method is not utilized in practice. The reasons for the uselessness are in that the waste liquid delivered from the enzyme-treatment procedure for the pulp is in too large a volume, and contains the saccharide in a low content, and the content of impurities, for example, various organic acids generated during the pulping and oxygen-bleaching procedures for lignin, cellulose and hemicellulose, in the filtrate is very high. Namely, in this case, the activated carbon and the ion-exchange resins must be employed in a large amount for the recovery and refining; the concentration procedure of the filtrate by the reverse osmosis membrane causes the waste liquid to be generated in a large amount; the waste liquid contains water-insoluble components, for example, lignin, in a high content; and thus a large scale of production apparatus is necessary for the method of the Japanese publication.

In the conventional process for producing xylooligosaccharide, generally, arabinoxylan which is contained in wheat mold bran and corn cob obtained, as a by-product, from the production of corn foods, and glucuronoxylan of hardwood, are employed, as starting xylan materials applicable in industry. These materials are extracted by the above-mentioned method, and extract is treated with hemicellulase such as xylanase, to produce xylooligosaccharide comprising mono- to deca-mers of xylase, preferably mono-to penta-mers of xylose. The xylan containing material applicable for industry contains, in addition to xylose, arabinose, glucuronic acid, 4-O-methylglucuronic acid, glucose and glactose, and other mono-saccharides (as disclosed in, for example, Japanese Unexamined Patent Publication No. 4-53,801). To obtain xylooligosaccharide consisting of pure xylose only, the resultant xylooligosaccharide must be further refined in an accurate manner. Thus, a low cost process for producing the xylooligosaccharide is strongly demanded.

It is known that the xylanase treatment applied to the kraft pulp enables the necessary amount of bleaching chemicals for the bleaching process for the pulp with the bleaching chemical to be reduced. In the xylanase treatment, since the xylan contained in the pulp is hydrolyzed with xylanase, the resultant waste water discharged from the bleaching system contains xylose and xylooligosaccharide separated from the pulp in large amount. In paper industry, to reduce the amount of process water used, an amount of water used in a step of the bleaching procedure is returned to and utilized in another step before the above-mentioned step. Therefore, the water used in a step before the enzyme treatment step contains xylan-decomposition products, for example, xylose and xylooligosaccharide, isolated by xylanase.

The above-mentioned xylose and xylooligosaccharide have reducing terminal groups, for example, aldehyde groups, the reducing terminal groups are oxidized in the oxidation-bleaching procedure, for example, an oxygen-bleaching procedure and the xylose and xylooligosaccharide are converted to carboxylic acids and further to oxidized furan derivatives and then to colored furan condensation products, to consume the bleaching chemicals. Thus, in this case, the bleaching agents consumed due to the presence of the saccharides must be supplemented. Also, in the oxygen bleaching procedure under a high alkaline condition, the aldehyde groups are oxidized and the resultant carboxylic acid causes the pH value of the bleaching system to be reduced. Thus the pH values of the bleaching system must be controlled to a desired level by increasing the amount of alkali to be added to the bleaching system to compensate the reduction in pH.

In an attempted method in which xylose and xylooligosaccharide produced by the xylanase treatment is not returned to a preceeding bleaching step, the reducing saccharides are removed from the waste water discharged from the enzyme treatment system, and the resultant saccharide-free waste water is returned to a preceeding bleaching step. However, the waste water from the pulp production is generated in a large amount, and thus the removal of the saccharide by a conventional method, for example, the reverse osmosis membrane method, causes a very large scale of apparatus to be provided. Therefore, the above-mentioned removal of saccharide has not yet been carried out at a low cost.

SUMMARY OF THE INVENTION

An object of the present invention is to provide a process for producing xylooligosaccharide from a lignocellulose pulp, particularly a waste liquid delivered from an enzyme treatment step applied to the lignocellulose pulp, with a high efficiency and in a low cost.

The above-mentioned object can be attained by the process of the present invention for producing xylooligosaccharide from a lignocellulose pulp.

The xylooligosaccharide-producing process of the present invention comprises the steps of:

enzyme-treating a lignocellulose pulp with hemicellulase;

filtering the resultant reaction mixture delivered from the enzyme treatment step to separate a liquid fraction from the enzyme-treated pulp;

subjecting the liquid fraction delivered from the fraction step to a permeation treatment through a separation membrane to cause a non-permeated fraction containing xylooligosaccharide-lignin complex to be separated in an increased concentration thereof from a permeated fraction;

collecting the non-permeated fraction containing the xylooligosaccharide-lignin complex in the increased concentration; and separating and recovering xylooligosaccharide from the collected non-permeated fraction.

In the xylooligosaccharide-producing process of the present invention, the lignocellulose pulp is preferably selected from lignocellulose chemical pulps.

In the xylooligosaccharide-producing process of the present invention, the lignocellulose chemical pulps are preferably selected from hardwood chemical kraft pulps.

In the xylooligosaccharide-producing process of the present invention, it is preferable that before the enzyme treatment step, the lignocellulose pulps is bleached in an aqueous alkali solution with oxygen.

In the xylooligosaccharide-producing process of the present invention, preferably, in the enzyme treatment step, xylanase is employed as a hemicellulase.

In the xylooligosaccharide-producing process of the present invention, preferably, the xylooligosaccharide is collected from the non-permeated fraction containing the xylooligosaccharide-lignin complex by adjusting the pH value of the non-permeated fraction to 2 to 4, heating the pH-adjusted non-permeated fraction at a temperature of 100 to 170° C. to produce mono- to deca-mers of xylose from the xylooligosaccharide-lignin complex; and recovering the di- to deca-mers of xylose.

In the xylooligosaccharide-producing process of the present invention, preferably, before the recovering procedure, the heated non-permeated fraction is subjected to a membrane separation to collect a mixture of xylooligosaccharide with the di- to deca-mers of xylose from the heated non-permeated fraction.

In the xylooligosaccharide-producing process of the present invention, the collected mixture of the xylooligosaccharide with xylose di- to deca-mers is preferably subjected to a treatment with an ion-exchange resin, to decolor and refine the xylooligosaccharide, before the separating and recovering step.

In the xylooligosaccharide-producing process of the present invention, preferably, the liquid fraction delivered from the filtration step is mixed with a flocculant selected from the group consisting of inorganic flocculants and polymeric flocculants; the resultant flocculate is removed from the liquid fraction by filtration; and the resultant flocculate-free filtrate is subjected to the permeation treatment through the separation membrane.

DESCRIPTION OF THE PREFERRED EMBODIMENTS

Figure 1:
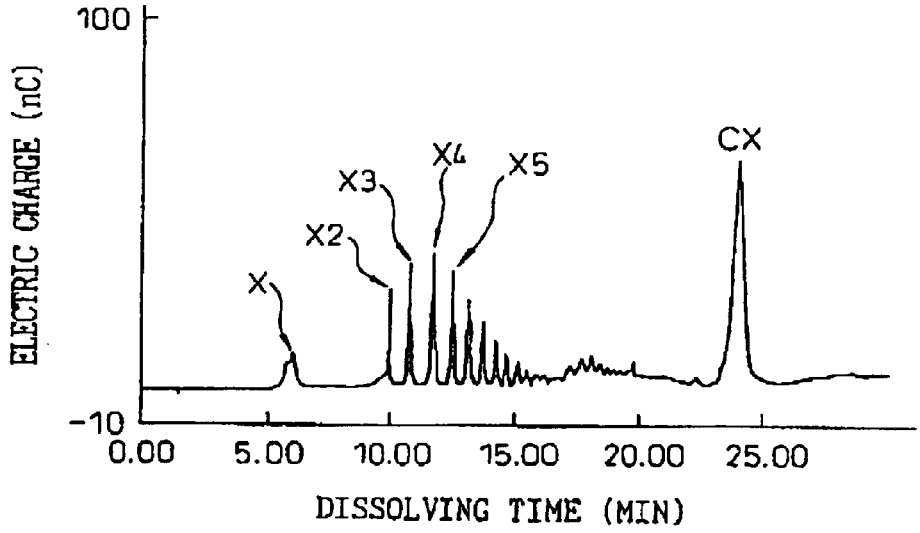
FIG. 1 is a chromatogram of a non-permeated fraction obtained by a reverse osmosis treatment of Example 1.

The inventors of the present invention have made extensive research into the influence of waste water delivered from an enzyme treatment for a pulp and employed as a liquid medium for bleaching a pulp by an alkali-oxygen bleaching (oxygen delignification) procedure, in an countercurrent relationship to the stream of the pulp in the bleaching procedure, on the bleaching effect, and found that when the waste water from the enzyme treatment is subjected to a separation membrane treatment, for example, a reverse osmosis (RO) membrane treatment or a nanofiltration (NF) membrane treatment, the resultant permeated fraction contains substantially no or very little saccharide and lignin which affect the bleaching effect of the pulp with oxygen in an aqueous alkali solution, and is usable as a liquid medium of the alkali-oxygen bleaching system for the pulp, without affecting the bleaching effect. Also, it has been found that the non-permeated fraction separated from the permeated fraction by the separation membrane treatment contains saccharide in the form of a complex with a certain substance and in an increased concentration and is useful as a cheap source of xylooligosaccharide.

The present invention was completed on the basis of the above-mentioned findings.

In the xylooligosaccharide-producing process of the present invention, there is no limitation to the sort of the lignocellulose pulp usable for the process. The lignocellulose pulp is preferably selected from softwood pulps and hardwood pulps and optionally selected from non-wood plant pulps, for example, kenaf, flax, bagasse and rice plant pulps. The pulp usable for the xylooligosaccharide-producing process of the present invention include chemical pulps, mechanical pulps and deinked waste paper pulps. Preferably the hardwood chemical pulps are used for the bleaching process of the present invention.

The chemical pulps can be produced by a conventional pulping method, for example, kraft pulping, polysulfite pulping, soda pulping or alkali-sulfite pulping method. In consideration of the quality of the resultant pulp and the energy efficiency of the pulping procedure, the kraft pulping method is preferably utilized. For example, in this case where wood chips are subjected to the kraft pulping procedure, preferably the kraft pulping liquid has a sulfidity of 5 to 75%, more preferably 15 to 45%, the content of effective alkali in the kraft pulping liquid is 5 to 30% by weight, more preferably 10 to 25% by weight, based on the bone-dry weight of the wood, the pulping temperature is 140 to 170° C., and the pulping procedure is carried out in a continuous system or in a batch system. When a continuous pulping apparatus is used, the apparatus may have a plurality of inlets for supplying the pulping liquid into the pulping apparatus. There is no limitation to the type of the continuous pulping apparatus.

In the pulping procedure, the pulping liquid optionally contains a pulping auxiliary comprising at least one member selected from the group consisting of cycloketo compounds, for example, benzoquinone, naphthoquinone, anthraquinone, anthorone and phenanthraquinone; alkyl and/or amino group-substituted derivatives of the cycloketo compounds; hydroquinone compounds, for example, anthrahydroquinone, which are reduction products of the above-mentioned quinone compounds; and 9,10-diketohydroanthracene compounds which are obtained as a by product in synthesis of anthraquinone compounds by a Diels-Alder reaction and have a high chemical stability. The pulping auxiliary is added in an amount of 0.001 to 1.0% by weight based on the bone dry weight of the wood chips to the bleaching system.

The lignocellulose pulp for the process of the present invention is preferably selected from chemical pulps bleached in an aqueous alkali solution with oxygen.

The alkali-oxygen bleaching procedure may be carried out in accordance with the conventional moderate consistency method or high consistency method. Preferably, the bleaching procedure is carried out in accordance with the moderate consistency method in a pulp concentration of 8 to 15% by weight, which method is currently commonly employed.

In the alkali-oxygen bleaching procedure in accordance with the moderate consistency method, preferably an aqueous sodium hydroxide solution or an oxidized kraft white liquor is used as an aqueous alkali solution, and the oxygen gas is selected from those prepared by cryogenic separation method, by PSA (pressure swing adsorption) method and by VSA (vacuum swing adsorption) method. The oxygen gas and the aqueous alkali solution is mixed into an aqueous pulp slurry having a moderate consistency of the pulp by using a moderate consistency mixer, and after they are fully mixed with each other, the mixture containing the pulp mixed with oxygen and alkali is fed under pressure into a bleaching reaction column which has capacity large enough to store the mixture for a desired time, to delignify the pulp.

In the bleaching procedure, the oxygen is employed in an amount of 0.5 to 3% by weight based on the bone-dry weight of the pulp, the alkali is employed in an amount, in terms of NaOH, of 0.5 to 4% by weight based on the bone dry weight of the pulp, the reaction time is 15 to 100 minutes and the consistency of the pulp is 8 to 15% by weight. Other conditions for the bleaching procedures may be established in accordance with the conventional bleaching processes.

Preferably, the alkali-oxygen bleaching procedure is continuously carried out plural times to promote the delignification of the pulp as much as possible.

In the oxyooligosaccharide-producing process of the present invention, a reaction mixture delivered from the enzyme treatment system for a pulp is filtered to collect the enzyme-treated pulp from the reaction mixture, the resultant filtrate, namely a liquid fraction of the reaction mixture is subjected to a permeation treatment through a separation membrane to separate a permeated fraction and a non-permeated fraction. The pulp for the enzyme treatment is preferably selected from chemical pulps, particularly hardwood chemical kraft pulps. The chemical pulps are preferably bleached chemical pulps. The permeation treatment is preferably carried out by using a membrane for reverse osmosis or for nanofiltration (NF). The permeated fraction is used as mentioned above, and the non-permeated fraction is subjected to a xylooligosaccharide-collecting procedure.

The enzyme treatment for the pulp is carried out by using hemicellulase, particularly xylanase.

In the enzyme treatment procedure, preferably a bleached pulp mixture delivered from the alkali-oxygen bleaching step of the lignocellulose pulp is fed into the enzyme treatment system. However, when the bleached pulp mixture contains a chlorine-containing bleaching chemical or chlorine ions in a large amount, a filtrate prepared from the bleached pulp mixture is not preferred to be employed in the enzyme treatment, because when the filtrate is used in the enzyme treatment and then returned to a pulping step through a countercurrent washing step, scale may be generated on the inside surface of the pulping apparatus, or when returned to a black liquor-recovery boiler step, liquid-transporting pipes may be corroded.

The enzyme usable for the enzyme treatment step of the process of the present invention is preferably selected from hemicellulase, much as xylanase, manganese peroxidase and laccase mediator system. In the present time, the enzyme practically utilized for a large scale of enzyme treatment is mostly selected from hemicellulase. All the trade-available hemicellulase can be used for the enzyme treatment step of the process of the present invention. For example, hemicullulase-containing agents available in trade under the trademark of CALTAZYME, made by CLARIANT CO., ECOPULP, made by RHOM ENZYME FINLAND OY, or SUMIZYME, made by SHINNIHON CHEMICAL CO., and xylanase produced by microorganisms in genus *Tricoderma,* genus *Termomyces,* genus *Aureobasidium,* genus *Streptomyces,* genus *Aspergillus,* genus *Clostridium,* genus *Bacillus,* genus *Dermatoga,* genus *Thermoascus,* genus *Cardoceram* and genus *Thermomonospora,* can be employed. Such hemicellulase contributes to enhancing the bleaching efficiency in the enzyme treatment step by decomposing and removing the hemicellulose in the chemical pulp.

In the xylooligosaccharide-collecting procedure, the pulp is subjected to an enzyme treatment using hemicellulase, and after the permeation treatment using the separation membrane is completed, the resultant non-permeated fraction is collected. In the non-permeated fraction, xylooligosaccharide-lignin complex is concentrated. The concentrated xylooligosaccharide is separated from the non-permeated fraction. In this embodiment, the xylooligosaccharide is collected from the non-permeated fraction which contains xylooligosaccharide-lignin complex by adjusting the pH value of the non-permeated fraction to 2 to 4; heating the pH-adjusted non-permeated fraction at a temperature of 100 to 200° C., preferably 105 to 170° C., more preferably 110 to 125° C., for preferably 1 to 120 minutes. During the heating procedure, the xylooligosaccharide complex which preferably has a molecular weight of 1500 or more is converted to a mixture of mono- to deca-mers of xylose. The di- to deca-mers of xylose is recovered together with the remaining xylooligosaccharide from the heated non-permeated fraction.

The di- to deca-mers of xylose is collected from the xylooligosaccharide. Before the collection, the mixture of the xylooligosaccharide with the xylose di- to de-camers is optionally subjected to a treatment with an ion-exchange resin to decolor and refine the xylooligosaccharide mixture.

In the xylooligosaccharide-collecting procedure, in which the enzyme treatment is carried out by using hemicellulase, and the resultant reaction mixture delivered from the enzyme treatment step is filtered to collect the treated pulp, the resultant filtrate is mixed with a flocculant selected from the group consisting of inorganic flocculants and cationic polymeric flocculants, the resultant flocculate is removed from the filtrate, the flocculate-free filtrate is subjected to a permeation treatment through a separation membrane, the resultant non-permeated fraction containing xylooligosaccharide complex in an increased concentration is collected and subjected to a procedure for separating and collecting xylooligosaccharide from the non-permeated fraction.

In the xylooligosaccharide-collecting procedure, the xylooligosaccharide complex-containing reaction mixture is obtained from the hemicellulase treatment system for a lignocellulose-containing chemical or mechanical pulp. The chemical pulp is preferably selected from kraft pulps, and soda pulps, more preferably hardwood kraft pulps. The pulp for the enzyme treatment is optionally digested or digested and oxygen-bleached, before the enzyme treatment.

The enzyme treatment in the process of the present invention is preferably carried out in a pulp consistency of 1 to 30% by weight, more preferably 2 to 15% by weight. When the pulp consistency is less than 1% by weight, a large capacity of the treatment apparatus may be necessary and this may be disadvantageous in practice. When the pulp consistency is more than 30% by weight, the pulp may be difficult to be uniformly mixed with the enzyme or the culture product of the enzyme.

The enzyme treatment is preferably carried out at a temperature of 10 to 90° C., more preferably 30 to 60° C. The treatment temperature is preferably close to the optimum temperature of the enzyme. In the case of common enzyme, when the treatment temperature is less than 10° C., the enzyme reaction may be insufficient and it may be very costly to maintain the enzyme treatment system at the low temperature of less than 10° C. Also, when the treatment temperature is more than 90° C., it may be necessary to tightly seal the treatment apparatus to prevent a heat loss, and the common enzyme may be modified and inactivated.

The enzyme treatment system preferably has a pH value of 3 to 10, more preferably 5 to 9, which should be close to the optimum pH value for the enzyme. If necessary, the pH value of the enzyme treatment system can be adjusted to a desired value by adding an aqueous acid or alkaline solution to the system. Of course, the pH adjustment can be effected by using a waste water delivered from the multi-stage bleaching step.

There is no limitation to the treatment time of the enzyme treatment procedure. Usually, the enzyme treatment time is preferably 10 minutes or more, more preferably 30 to 180 minutes.

The enzyme treatment procedure may be effected in a single stage or in multiple stages. The multiple enzyme treatment procedures may be carried out by using the same enzyme as each other, or by using two or more types of enzymes different from each other. The enzyme treatment procedure in the process of the present invention can be carried out in any container, for example, reactor column, tank, or chest, which may be new or not new. The enzyme treatment procedure may be carried out in a pressure-resistant container under pressure.

The reaction mixture delivered from the enzyme treatment system is filtered to recover the enzyme-treated pulp, and a filtrate containing various saccharide is collected. The proportions of xylose and xylooligosaccharide contained in the filtrate are variable in response to the type of the enzyme used in the enzyme treatment, and thus the filtrate contains, as a major component of the saccharide, sometimes xylose, or xylobiose, or xylotriose. For example, when in the enzyme treatment, *Bacillus* sp. S-2113 strain is used, the resultant filtrate obtained from the reaction mixture delivered from the enzyme treatment contains xylose tetramer as a highest content component and xylose monomer as a low content component. When a hardwood kraft pulp is used, the filtrate contains substantially no glucose and arabinose, and xylose is contained in a content close to 100% based on the total content of saccharides, in the filtrate.

The filtrate is optionally filtered through a filter with 5 $\mu$m size openings to remove insoluble substances, and then subjected to a permeation treatment through a reverse osmosis membrane. In the resultant permeated fraction, xylose, glucose, arabinose and xylooligosaccharide are detected. The total content of the all the saccharides in the permeated fraction is about 30% by weight based on the total content of the all saccharides in the filtrate. Also, in the non-permeated fraction remained in the inlet side of the reverse osmosis membrane, very small contents of oligosaccharide and monosaccharide are detected. However, about 70% by weight of all the saccharides contained in the filtrate are recovered, in the form of xylooligosaccharide complex, in the non-permeated fraction. For the permeation treatment, a membrane for nanofiltration which membrane is referred to a nanofiltration, and is used in the electrically charged state, may be used in place of the reverse osmosis membrane. The nanofiltration membrane exhibit a rejection to common salt (NaCl) of about 50% and can be employed in the same manner as the reverse osmosis membrane. When the nanofiltration membrane is used for the permeation treatment, the total recovery of all the saccharides is about 70% which is similar to that by the reverse osmosis membrane. A conventional ultrafiltration membrane may be utilized for the permeation treatment. In this case, the total recovery of all the saccharides is about 30%.

The xylooligosaccharide-lignin complex contained in the reaction mixture delivered from the enzyme-treatment system for the pulp can be concentrated by conventional physical and/or chemical procedures, for example, evaporation, flocculation-deposition, and extraction in a solvent. However, a separation method in which the target xylooligosaccharide is allowed to permeate through a membrane which does not allow the xylooligosaccharide complex to permeate therethrough, and the complex is concentrated in the inlet side of the membrane, is advantageously employed in industry. This permeation treatment is advantageous in that no use of specific substances, for example, solvent is necessary, and the operation cost is low. Also, this treatment is advantageous in that the xylooligosaccharide can be separated and removed, together with various inorganic substances, for example, sodium carbonate and sodium, and organic substances, for example, monosaccharides such as dextrose, xylose and arabinose, oligosaccharides, organic acids and low molecular weight organic substances derived from lignin and others.

When the permeation treatment by using the separation membrane, for example, reverse osmosis membrane or ultrafiltration membrane is carried out, colloidal substances or suspended particles in the filtrate are adhered to and accumulated on the surface of the membrane, the specific resistance of the membrane to permeation increases with the lapse of operation time, and the permeation rate of the filtrate through the membrane is decreased. In practice, it is important that the deterioration in the permeation performance of the membrane or membrane module is minimized, and the permeation performance is stabilized over a long operation time. For this purpose, the filtrate is subjected to a pre-treatment for removing the above-mentioned colloidal substances and particles, for example, a flocculation and deposition treatment or filtration treatment, before the permeation treatment. The filtrate obtained from the reaction mixture delivered from the hemicellulase treatment system contains lignin, antifoamer and fine insoluble substances which are difficult to remove by the filtration using a usual filter, and are suspended in the filtrate, and the suspended substance causes the permeation rate of the filtrate through the membrane to be decreased. The decrease in the permeation rate can be prevented by a pre-treatment in which a flocculant is added to the filtrate and the resultant flocculate is removed from the filtrate to make the filtrate clear. The flocculant usable for the pre-treatment preferably comprises at least one member selected from inorganic flocculants, for example, aluminum sulfate and poly(aluminum chloride); synthetic polymeric flocculants, for example, polyacrylamides and polyamines; and natural polymeric flocculants, for example, chitosan. The amount of the flocculant to be added to the filtrate is established in consideration of the type of the flocculant and the composition of the filtrate to be treated. The aluminum sulfate is used in an amount of 500 to 1000 ppm based on the weight of the filtrate, and the pH value of the aluminum sulfate-added filtrate is adjusted to 7.5 by adding sodium hydroxide. The synthetic polymeric flocculant is employed in an amount of about 5 to 30 ppm and chitosan is employed in an amount of about 30 to 60 ppm. The flocculate generated in the filtrate is removed by using a centrifugation or other filter, for example, precoat filter, bag filter or filter press. After the filtrate is pre-treated by the flocculation and flocculate-removal, the resultant filtrate exhibits a higher degree of clarity than that of the non-pretreated filtrate, and thus the decrease in the permeation rate of the filtrate in the permeation treatment can be prevented.

The xylooligosaccharides are di- or more-mers of xylose. The xylose has a molecular weight of 150, xylose dimer 282, xylose trimer 414 and thus each xylose group in the oligomers causes an increase in the molecular weight of 132. The xylose decamer has a molecular weight of 1339. The xylooligosaccharides contained in an increased content in the non-permeated fraction of the filtrate are in the form of a complex of xylooligosaccharides with polymeric substances contained in the reaction mixture delivered from the enzyme treatment system, for example, lignin, or lignocellulosic materials or furan derivatives from the hemicellulose, which are produced during the pulping procedures.

All the saccharides contained in the non-permeated fraction of the filtrate are mainly composed of xylose and thus when the pH value of the non-permeated fraction is adjusted to a level lower than 5 by adding an acid, and the pH-adjusted non-permeated fraction is heated at a high temperature, for example, 105° C. to 170° C., the xylooligosaccharides are liberated from the xylooligosaccharide-complex. There is no limitation to the type of the acid for adjusting the pH value of the non-permeated fraction. Usually, the pH-adjusting acid is selected from mineral acids, for example, sulfuric acid and hydrochloric acid and organic acids, for example, oxalic acid and acetic acid.

The pH value of the non-permeated fraction is preferably adjusted to a level of from 1.5 to 5, more preferably from 2 to 4, still more preferably 3.5 to 4.0. When the pH value is less than 1.5, the hydrolysis of xylose may be promoted and thus the yield of xylooligosaccharide may be reduced. Also, when the pH value is more than 5, the liberation of xylooligosaccharide at a temperature of about 150° C. or less may be promoted.

The heating temperature necessary to liberate the xylooligosaccharide is not limited to a specific level as long as the xylooligosaccharide is liberated. Usually the xylooligosaccharide is liberated from the complex thereof at a temperature of 100 to 200° C., preferably 105 to 175° C., more preferably 110 to 125° C. When the heating temperature is less than 100° C., the xylooligosaccharide complex may not be decomposed to liberate xylooligosaccharide. Also, when the heating temperature is 200° C., the decomposition of the xylooligosaccharide complex to produce monosaccharide, namely xylose may be promoted, and thus the yield of the xylooligosaccharide may be reduced. The conversion of the xylooligosaccharide complex to xylooligosaccharide is preferably carried out under a pressure of from the ambient atmospheric pressure to 4,990,332.5 Pa (5 kg/cm$^2$).

The reaction time necessary for the liberation of xylooligosaccharide is variable in response to the amount of the acid added to the reaction system, and pH and temperature of the reaction system. For example, when the pH value of the reaction system is adjusted to 3.5 by adding sulfuric acid, and the temperature is controlled to 120° C., the reaction time is preferably about 15 minutes. In practice the target xylooligosaccharide can be obtained in a derived proportion by controlling the reaction conditions, such as pH and temperature of the reaction system and the reaction time. Also, it is possible to enhance the yields of xylose and xylobiose by reacting suitable xylanase and hemicellulase to the xylooligosaccharide complex.

After the acid treatment, the resultant xylooligosaccharide-containing composition contains water-insoluble substances, for example, lignin and coloring substances. The water-insoluble substances can be removed from the reaction mixture by a filtration, centrifugal separation and filter cloth-filtration. Colored impurities dissolved in the acid treatment mixture can be any conventional method, for example, activated carbon-absorption method, ion exchange method using strong basic anion exchange resin, for example, AMBERLITE (trademark, made by RHOM & HAAS, weak basic anion exchange resin strong acid cation exchange resin or weak acid cation exchange resin, or membrane-filtration method which method may be repeated alone or in combination of two or more thereof. For example after the heat treatment is completed, the xylooligosaccharide complex-containing mixture is filtered through a filter cloth to remove the water-insoluble substances, and is permeated through an ultrafiltration membrane, the permeated fraction is treated with weak basic and strong basic ion exchange resins, the non-absorbed fraction on the ion-exchange resins is treated with a small amount of activated carbon to decolor the fraction and then is subjected to a demineralization treatment by using an ampholeric ion exchange resin for demineralization, to obtain the target xylooligosaccharide.

By the above-mentioned series of treatments, xylooligosaccharide can be obtained in an amount of about 70 kg from a treatment mixture of about 1000 liters after the acid treatment.

The reaction mixture obtained by the heat treatment of the non-permeated fraction of the filtrate has a characteristic feature that the content of monosaccharides, for example, xylose, glucose and arabinose is low, because, almost all of these monosaccharides contained in the filtrate of the reaction mixture delivered from the enzyme treatment procedure are removed by the permeation treatment by the separation membrane. This characteristic feature is advantageous in that the growth of coliform bacteria can be selectively repressed.

In the process of the present invention, organic substances, for example the lignin and saccharides contained in the filtrate of the reaction mixture delivered from the enzyme treatment can be removed by filtering through the ultrafiltration membrane. Generally, in the bleaching sequence for the pulp, the process water is basically repeatedly employed in countercurrent washing procedures. Therefore, in a preceding step using the filtrate containing the organic substances such as lignin, the organic substances can be removed and thus the efficiency in the preceding step, for example, the oxygen-bleaching step and the pulping step can be enhanced, the whiteness of the resultant pulp can be improved and the consumption of beaching chemicals and energy can be saved.

Also, by removing the organic substances such as lignin and saccharides in the filtrate by using the separation membrane, the content of the organic substances in the waste water delivered from the bleaching procedure and sent to a later bleaching step can be reduced. This reduction enables the COD (chemical oxygen demand) in the final waste water delivered from the bleaching procedure to be reduced.

In the xylooligosaccharide producing procedure, a xylooligosaccharide composition having a low content of xylose which is a monosaccharide and a high content of oligomers (for example, di- to deca-mers preferably tri- to deca-mers) of xylose can be easily produced.

Figure 2:
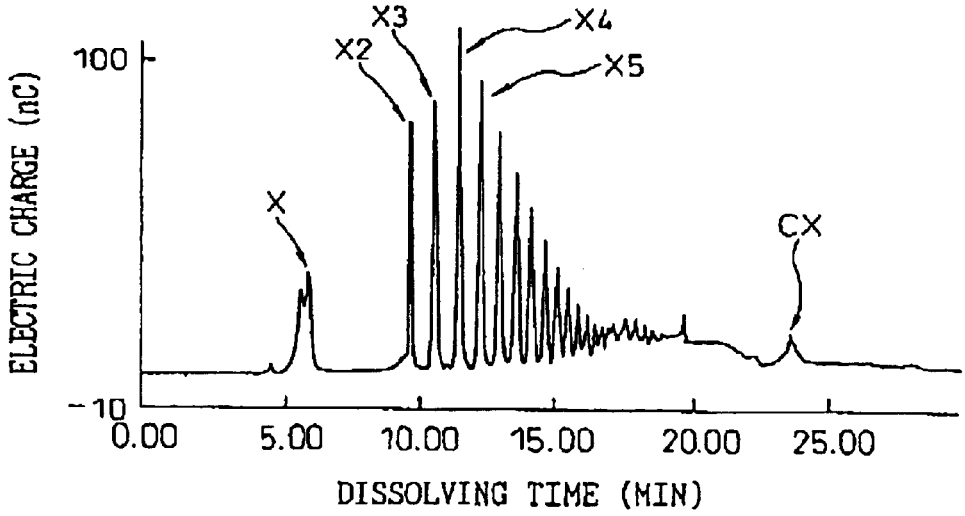
FIG. 2 is a chromatogram of a heat treatment product of the non-permeated fraction obtained in Example 3-(1)

For example, as shown in FIG. 2, in the process of the present invention, the resultant xylooligosaccharide composition contain 2 deca- to eicosa-mers, and a fraction of xylooligosaccharide having a high degree of polymerization can be collected by selection.

EXAMPLES

The present invention will be further illustrated by the following examples, which are merely representative but are not intended to restrict the scope of the present invention in any way.

Example 1

Preparation of Bleached Pulp

A mixed hardwood chips consisting of 70% by weight of Japanese hardwood chips and 30% by weight of eucalyptus wood chips was pulped by a kraft digesting method in factory. The resultant unbleached pulp had a kappa value of 20.1 and pulp viscosity of 0.041 Pa·s (41 cP). The unbleached pulp was subjected to an alkali-oxygen bleaching procedure in a pulp consistency of 10% in by weight in an aqueous solution of 1.20% by weight of sodium hydroxide based on the bone dry weight of the pulp, with a compressed oxygen gas under a gauge pressure of 4,990, 332.50 Pa (5 kg/cm$^2$), at a temperature of 100° C. for 60 minutes. The bleached pulp had a kappa value of 9.6 and a pulp viscosity of 0.0251 Pa·s (25.1 cP).

Enzyme Treatment

The pulp was collected through a 100 mesh filter cloth, washed with water and a pulp slurry having a pulp consistency of 10% by weight was prepared. The pH value of the pulp slurry was adjusted to a level of 8.0 by adding a diluted aqueous sulfuric acid solution, and mixed with xylanase produced by *Bacillus*·SP-s-2113 strain (Life Engineering Industry Technical Laboratory, Industrial Technical Agency, The Ministry of International Trade and Industry, deposited strain FERM BP-5264), in an amount of one unit per gram of the pulp, and the resultant enzyme treatment system was heated at a temperature of 60° C. for 120 minutes. After the treatment was completed, the pulp residue was collected by a filtration through a 100 mesh filter cloth, and a filtrate having a volume of 1050 liters, a total saccharide concentration of 3700 mg/liter and a total saccharide amount of 3900 g, was obtained.

Permeation Treatment

The filtrate was subjected to a permeation treatment through a reverse osmosis membrane (trademark: RO NTR-7410, made by NITTO DENKO CORPORATION, membrane-forming material: sulfonated polyethersulfon polymer, common salt-rejection: 10%), to concentrate the filtrate at a volume ratio of the filtrate to a non-permeated fraction of 40. The non-permeated fraction (saccharide concentrated solution) had a total saccharide amount of 2700 g and a total saccharide yield of 70%.

The contents of xylooligosaccharide and xylooligosaccharide-lignin complex in the non-permeated fraction was determined by an ion chromatography (column an for ion-chromatography: PA-10) made by DIONEX CO.

The determination result in shown in Table 1.

FIG. 1 shows a chromatogram of a sample which was prepared by heating the non-permeated fraction at a pH value of 5.0 at a temperature of 121° C. for one hour and diluting the heated sample with water at a diluting volume ratio of 1/100.

In FIG. 1, the axis of ordinates shows the electric charge (nC) of the analysis sample, and the axis of abscissas shows the dissolving time (minute) of the analysis sample. Also, in FIG. 1, a peak x represents a monomer of xylose in a dissolving time of 6 minutes, $x_2$ dimer of xylose in a dissolving time of 9.2 minutes, $X_3$ trimer of xylose in a dissolving time of 10.3 minutes, $x_4$ tetramer of xylose in a dissolving time of 11.4 minute), $x_5$ pentamer of xylose in a dissolving time of 12.5 minutes, followed by peaks corresponding to hexamer, heptomer . . . , and a peak CX represents xylooligosaccharide-lignin complex in a dissolving time of 23.8 minutes. FIG. 1 and Table 1 clearly show that the content of the xylooligosaccharide in the non-permeated fraction (saccharide-concentrated solution) was low.

In Example 1, no heat-treatment in acidic side was applied to the non-permeated fraction (saccharide-concentrated solution) of the filtrate.

Example 2-(1)

The pH value of the same non-permeated fraction (saccharide-concentrated solution) as in Example 1 was adjusted to 5.0 by using acetic acid or oxalic acid. Each of the pH-adjusted samples of the non-permeated fraction was heat-treated at a temperature of 121° C. for one hour, and subjected to the same analysis as in Example 1. From the analysis results, it was confirmed in comparison with the analysis results of Example 1, that the heat treatment of the sample at a pH of 5.0 adjusted by using acetic acid or oxalic acid caused substantially no production of xylooligosaccharide to occur.

In Table 1, only the analysis results in the case where oxalic acid was used. However, in the case where acetic acid is used in place of oxalic acid, the same results as by oxalic acid were obtained.

Example 2-(2)

The pH value of the same non-permeated fraction (saccharide-concentrated solution) as in Example 1 was adjusted to 3.5 by adding oxalic acid or sulfuric acid. Each of the pH-adjusted samples of the non-permeated fraction was heat-treated at a temperature of 100° C. for one hour and then subjected to the same analysis as in Example 1. In the analysis results, it was confirmed in comparison with the analysis results of Example 2-(1) in which the heat treatment was carried out at a temperature of 121° C. that the heat treatment of the pH-adjusted samples caused substantially no production of xylooligosaccharide to occur.

In Table 1, only the analysis results by using oxalic acid are shown. When the sulfuric acid is used, the same results as those by oxalic acid were obtained.

Example 3-(1)

A sample of the same non-permeated fraction (saccharide-concentrated solution) as in Example 1 was added with sulfuric acid to adjust the pH value of the non-permeated fraction to 3.5. The sample having a pH value of 3.5 was heated at a temperature of 121° C. for one hour.

The resultant sample was subjected to the same ion-chromatographic analysis using a ion chromatographic column (trademark: PA-10, made by DIONEX CORPORATION). For the analysis results, it was found in comparison with the analysis results of Example 1 that the heat treatment caused the production of the xylooligosaccharides (including di- to deca-mers of xylose to be promoted. The results are shown in FIG. 2. FIG. 2 shows a chromatogram of a sample of the non-permeated fraction having a pH of 3.5, heat treated at 121° C. for one hour, and diluted with water in a diluting ratio of 40.

In FIG. 2, the electric charge (in nC) of the analysis sample is shown on the axis of ordinates, and the dissolving time (in minute) of the analysis sample is shown on the axis of abscissas.

In FIG. 2, a peak of xylose monomer is exhibited at a dissolving time of 6 minute, a peak of xylose dimer at a dissolving time of 9.2 minutes, a peak of xylose trimer at a dissolving time of 10.3 minutes, a peak of xylose tetramer at a dissolving time of 11.4 minutes, a peak of xylose pentamer at a dissolving time of 12.5 minutes, followed by peaks corresponding to hexa- and hepta- or more mers of xylose, and a peak of xylooligosaccharide complex at a dissolving time of 23.8 minutes.

Namely FIG. 2 shows that the heat treatment of the non-permeated fraction in Example 3-(1) contributed to promoting the production of the xylooligosaccharides (di- to deca-mers of xylose), in comparison with that in Example 1.

Example 3-(2)

The same procedures as in Example 3-(1) were applied to the same non-permeated fraction as in Example 4, except that in the pH adjustment to 3.5, the sulfuric acid was replaced by oxalic acid, acetic acid or hydrochloric acid. The results of the heat treatment were substantially same as those in Example 3-(1). The contents of the xylose, xylose oligomers (di- to de-camers), and xylooligosaccharide-complex are shown in Table 1.

Example 4

The same non-permeated fraction (saccharide-concentrated solution as in Example 1 was mixed with sulfuric acid, oxalic acid or hydrochloric acid to adjust the pH value thereof to 1.5, and then heat-treated at a temperature of 121° C. for one hour, and each sample of the heat treated solutions was subjected to the same analysis as in Example 1.

In each sample, it was confirmed that the xylooligosaccharide was decomposed to xylose. Namely, in the heat-treated samples, the content of the xylose (monomer) is highest, as shown in Table 1.

Example 5

The same non-permeated fraction (saccharide-concentrated solution as in Example 1 was mixed with sulfuric acid or oxalic acid to adjust the pH value thereof to 5.0, and then heat-treated at a temperature of 155° C. for one hour, and each sample of the heat treated solutions was subjected to the same analysis as in Example 1.

In each sample, it was confirmed that in the heat-treated samples, the contents of the xylose (monomer) and lower oligosaccharides, for example, xylobiose, were increased, as shown in Table 1. In Table 1, only the results of the heat treatment using the sulfuric acid. In the case where oxalic acid is used in place of sulfuric acid, substantially the same results as by sulfuric acid were obtained.

Example 6

The same non-permeated fraction (saccharide-concentrated solution as in Example 1 was mixed with sulfuric acid or oxalic acid to adjust the pH value thereof to 3.5, and then heat-treated at a temperature of 121° C. for 30 minutes or 15 minutes, and each sample of the heat treated solutions was subjected to the same analysis as in Example 1.

In each sample, it was confirmed that the xylooligosaccharides were produced in a yield similar to that in Example 3-(1) wherein the heat treatment was carried out at 121° C. for 60 minutes, as shown in Table 2.

TABLE 1

| Example No. | Type of acid | pH | Temperature (° C.) | Time (min) | X (%) | X2 (%) | X3 (%) | X4 (%) | X5 (%) | >X6 (%) | CX (%) |
|---|---|---|---|---|---|---|---|---|---|---|---|
| | Item | | | | | | | | | | |
| | Heat, acid treatment | | | | Product percentage of area of peak portion on chromatogram | | | | | | |
| Example 1 | — | — | — | *** | 6.4 | 5.7 | 7.8 | 7.6 | 2.1 | 0.0 | 70.4 |
| 2-(1) | Oxalic acid | 5.0 | 121 | 60 | 6.5 | 5.5 | 8.0 | 7.5 | 2.2 | 0.1 | 70.2 |
| 2-(2) | Oxalic acid | 5.0 | 100 | 60 | 6.4 | 6.0 | 7.8 | 7.6 | 2.1 | 0.0 | 70.1 |
| 3-(2) | Oxalic acid | 3.5 | 121 | 60 | 2.5 | 12.9 | 29.6 | 39.1 | 11.3 | 2.7 | 1.9 |
| | Acetic acid | 3.5 | 121 | 60 | 2.4 | 18.2 | 27.3 | 34.2 | 10.1 | 0.4 | 7.4 |
| | Hydrochloric acid | 3.5 | 121 | 60 | 13.1 | 15.1 | 23.1 | 28.7 | 8.4 | 2.4 | 9.2 |
| 4 | Sulfuric acid | 1.5 | 121 | 60 | 57.6 | 20.1 | 15 | 5.8 | 0.4 | 0.8 | 0.3 |
| | Oxalic acid | 1.5 | 121 | 60 | 40.0 | 38.4 | 17.2 | 2.5 | 1.6 | 0.3 | 0.0 |
| | Hydrochloric acid | 1.5 | 121 | 60 | 36.1 | 33.5 | 22.3 | 7.3 | 0.5 | 0.1 | 0.2 |
| 5 | Sulfuric acid | 3.5 | 155 | 60 | 13.2 | 16.3 | 25.3 | 24.6 | 9.5 | 2.5 | 8.6 |
| 6 | Sulfuric acid | 3.5 | 121 | 30 | 3.5 | 9.0 | 22.9 | 20.5 | 7.6 | 3.6 | 32.9 |
| | Sulfuric acid | 3.5 | 121 | 15 | 9.6 | 8.4 | 10.2 | 12.3 | 9.6 | 0.3 | 49.6 |
| | Oxalic acid | 3.5 | 121 | 30 | 13.2 | 14.9 | 24.6 | 26.3 | 9.5 | 2.9 | 8.6 |
| | Oxalic acid | 3.5 | 121 | 15 | 3.5 | 8.9 | 22.9 | 23.5 | 7.5 | 3.6 | 30.1 |

[Note]
X: Xylose, X2: Xylobiose, X3: Xylotriose, X4: Xylotetraose X5: Xylopentaose, >X6: Xylohexaose and higher oligomers, CX: Xylooligosaccharide complex.

Example 7

Refining (1) of Xylooligosaccharides Produced by Heat, Acid Treatment

The same non-permeated portion (saccharide-concentrated solution) of the filtrate as in Example 1 was mixed with oxalic acid to adjust the pH value thereof to 3.5, and then heat-treated at a temperature of 121° C. for 60 minutes, to prepare a xylooligosaccharide-containing solution having a total saccharide concentration of 140 mg/ml. The solution was filtered through a filter to remove water-insoluble solid impurities. The filtered xylooligosaccharide-containing solution in an amount of 10 ml was subjected to an ultra-filtration through an ultra-filtration membrane having a molecular cutoff of 8,000. A filter-passed fraction was obtained in an amount of 4 ml. The filter-passed fraction had a total saccharide amount of 280 mg.

Figure 3:
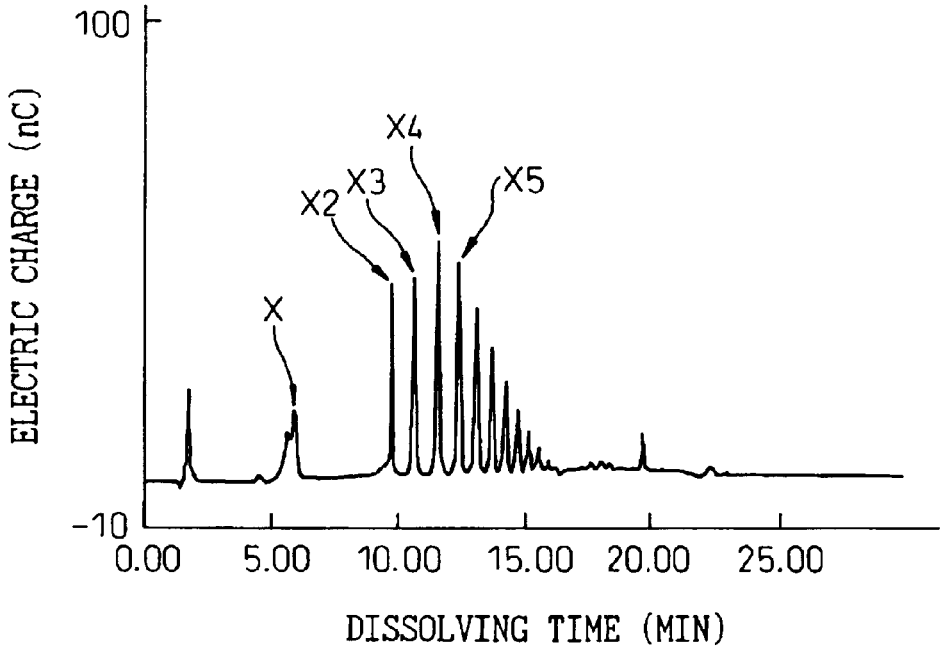
FIG. 3 is a chromatogram of the refined xylooligosaccharide solution obtained in Example 7.

The filter-passed fraction was treated with 30 mg of a strong basic ion-exchange resin (trademark: AMBERLITE GC-400, type 2, made by RHOM & HAAS) by a batch treatment method. After the ion-exchange treatment was completed, the total amount of the saccharides in the fraction was 260 mg. Finally, the ion-exchange resin-treated fraction was further treated with 30 mg of activated carbon (made by WAKO JUNYAKUKOGYO K.K.) and then with 30 mg of a desalting amphoteric ion-exchange resin (trademark: AMBERLITE MB3, made by RHOM & HAAS) in a batch type method to decolor and then desalt the fraction. A final refined xylooligosaccharide solution was obtained. The refined solution was diluted with water in a diluting ratio of 1:300 and was subjected to an ion chromatographic analysis. The resultant chromatogram is shown in FIG. 3. The diluted solution had a total saccharide amount of 113 mg. The final total recovery yield of the xylooligosaccharides was about 40% based on the total amount of the xylooligosaccharides in the ultra-filtration membrane-passed fraction. The final refined xylooligosaccharide solution had an impurity content of 0.9% by weight. In FIG. 3, the definitions of the axis of ordinates, the axis of abscissas, and symbols shown in the graph are the same as those in FIG. 1.

The analysis results are shown in Table 2.

TABLE 2

| Fraction | Total saccharide amount (mg) | Total dry amount (mg) | Ash content (mg) | Recovery (%) |
|---|---|---|---|---|
| | Item | | | |
| Ultra-filtration membrane-passed fraction after acid, heat treatment | 280 | 330 | 45 | 100 |
| Anion-exchange resin-treated fraction | 260 | 270 | 1 | 93.1 |
| Activated carbon and desalting ion exchange resin-treated fraction | 113 | 114 | 0.1 | 40.6 |

Example 8

Refining (2) of Xylooligosaccharides Produced by Heat, Acid Treatment

The same acid, heat-treated xylooligosaccharide solution in an amount of 250 ml, having a total saccharide content of 106 mg/ml and containing 26.5 g of the saccharides, as that prepared in Example 7 was loaded on a column having an inside diameter of 50 mm and a length of 200 mm and prepared from activated carbon (grade: 037-02115, made by WAKO JUNYAKUKOGYO K.K.). Thereafter, a recovery of xylooligosaccharides was tried by using, as a dissolving liquid medium, pure water or a 25% ethanol solution in pure water. When the pure water was employed as a dissolving liquid medium, no xylooligosaccharide was recovered. When the 25% ethanol solution was employed, the xylooligosaccharides absorbed in the activated carbon was dissolved therein and recovered. The recovered xylooligosaccharide was desalted with an amophoteric ion-exchange resin (trademark: AMBERLITE MB3, made by RHOM & HAAS CO.) by a batch type procedure, to provide refined xylooligosaccharides. The resultant xylooligosaccharides were in an amount of 5.5 g.

The effects of the activated carbon treatment are shown in Table 3.

TABLE 3

| Fraction | Item | | | |
|---|---|---|---|---|
| | Total saccharide amount (g) | Total dry amount (g) | Ash content (g) | Recovery (%) |
| Acid, heat-treated fraction | 26.5 | 32.5 | 5.5 | 100 |
| Activated carbon-treated fraction | 5.5 | 5.6 | 0 | 20.7 |

Example 9

Refining (3) of Acid, Heat-treated Xylooligosaccharide Solution

The same acid, heat-treated xylooligosaccharide solution in an amount of 10 ml, having a total saccharide content of 117 mg/ml and containing 1.2 g of saccharides, as that in Example 7 was loaded on a column having an inside diameter of 36 mm and length of 150 mm, and packed with strong acid ion-exchange resin (trademark: AMBERLITE 200C, made by RHOM & HAAS). A fraction of the solution passed through the ion-exchange resin column was recovered and further loaded on a column having the same dimensions as those mentioned above and packed with a weak basic ion-exchange resin (trademark: AMBERLITE IRA 67, made by RHOM & HAAS).

The fraction of the xylooligosaccharide solution passed through the cation-exchange resin column was mixed with 80 g of activated carbon (grade: 037-02115, made by WAKO JUNYAKUKOGYO K.K.; was adjusted at a temperature of 60° C. for one hour to decolor the saccharide solution. A refined xylooligosaccharide solution was obtained.

In the refined xylooligosaccharide solution, no absorption of ultraviolet rays having wavelengths of 280 nm and 250 nm was found. Namely, the refined xylooligosaccharide solution was completely free from ultraviolet ray-absorbing substances which were contained in the acid, heat-treated solution.

The content of ash remained in the ash was 0.1% by weight or less based on the weight of the acid, heat-treated xylooligosaccharide solution. The xylooligosaccharides was recovered with a recovery of 70.8% as shown in Table 4.

The measurement results are shown in Table 4.

TABLE 4

| Fraction | Item | | | |
|---|---|---|---|---|
| | Total saccharide amount (mg) | Ash content (mg) | Total saccharide recovery (%) | Ash retention (%) |
| Acid, heat-treated fraction | 1170 | 2540 | 100 | 100 |
| Strong acid ion-exchange resin-treated fraction | 1100 | 6.0 | 94.1 | 2.4 |

TABLE 4-continued

| Fraction | Item | | | |
|---|---|---|---|---|
| | Total saccharide amount (mg) | Ash content (mg) | Total saccharide recovery (%) | Ash retention (%) |
| Weak basic ion-exchange resin-treated fraction | 868 | 2.0 | 74.2 | 0.8 |
| Activated carbon-treated fraction | 828 | 0.3 | 70.8 | <0.1 |

Example 10

A mixed hardwood chips consisting of 70% by weight of Japanese hardwood chips and 30% by weight of eucalyptus wood chips was pulped by a kraft digesting method in factory. The resultant unbleached pulp had a kappa value of 20.1 and pulp viscosity of 0.041 Pa·s (41 cP). The unbleached pulp was subjected to an alkali-oxygen bleaching procedure in a pulp consistency of 10% by weight in an aqueous solution of 1.20% by weight of sodium hydroxide based on the bone dry weight of the pulp, with a compressed oxygen gas under a gauge pressure of 4,990,332.50 Pa (5 kg/cm$^2$), at a temperature of 100° C. for 60 minutes. The bleached pulp had a kappa value of 9.6 and a pulp viscosity of 0.0251 Pa·s (25.1 cP).

The pulp was collected through a 100 mesh filter cloth, washed with water and a pulp slurry having a pulp consistency of 10% by weight was prepared. The pH value of the pulp slurry was adjusted to a level of 8.0 by adding a diluted aqueous sulfuric acid solution, and mixed with xylanase produced by *Bacillus*.SP·s-2113 strain (Life Engineering Industry Technical Laboratory, Industrial Technical Agency, The Ministry of International Trade and Industry, deposited strain FERM BP-5264), in an amount of one unit per gram of the pulp, and the resultant enzyme treatment system was heated at a temperature of 60° C. for 120 minutes. After the treatment was completed, the resultant pulp was washed with water in a displacement press washer and the washed pulp was collected by a filtration and a washing filtrate having a total saccharide concentration of 1700 mg/liter was obtained.

The washing filtrate in an amount of 2,000 liters was filtered through a bag filter (trademark: PO-10P2P, made by ISP FILTERS PTE LTD) to remove water-insoluble solid impurities. The washing filtrate had a water-insoluble impurity content of 350 ppm, and the bag-filtered filtrate had a water-insoluble impurity content of 79 ppm. The water-insoluble impurity content of the filtrate was confirmed by measuring a SS concentration of the filtrate.

Each of the washing filtrate and the bag-filtrate was further filtered through a glass filter (trademark: ADVANTEC GA100, made by TOKYO POSHI KAISHA, LTD. and having a filter size of 47 mm); a water-insoluble fraction caught by the glass filter was dried at 105° C. for one hour; and the dry weight of the water-insoluble fraction was measured.

Separately, the same washing filtrate as that mentioned above in an amount of 2,000 liters was mixed with a cationic synthetic polymeric flocculant (trademark: ACOFLOCK C 492UH, made by MITSUI SYTEC) in an amount of 15 ppm based on the weight of the filtrate, the mixed filtrate was agitated to form flocculate. The flocculate-containing filtrate was filtered through a bag filter having a micron rate of 10

μm, to provide a clear filtrate. The bag-filtered filtrate contained 11 ppm of water-insoluble impurities.

Further, separately, the washing filtrate in an amount of 2,000 liters was mixed with a cationic natural organic polymeric flocculant (trademark: KIMITSUCHITOSAN L, made by KIMITSU KAGAKUKOGYO K.K.) in an amount of 50 ppm based on the weight of the washing filtrate; and the mixture was agitated to allow a flocculate to be generated. The flocculate-containing filtrate was filtered through a bag filter having a micronrate of 10 μm to provide a clear filtrate. In this clear filtrate, the water-insoluble impurities remained in an amount of 13 ppm. No loss of the saccharides due to the flocculate formation and the flocculate-filtration was found.

When a anionic flocculant or a non-ionic flocculent was added each in an amount of 50 ppm to the filtrate, no flocculate could be generated, as shown in Table 6.

Each of the above-mentioned three types of flocculant-treated filtrates derived from the washing filtrate was subjected to a permeation treatment through two pieces of a reverse osmosis membrane (trademark: RO-NTR-7450, membrane material: sulfonated polyether-sulfon polymer, salt rejection: 50% membrane area: 6.2m$^2$), at a filtrate temperature of 50° C., under inlet operation pressure of 980,665 to 1,961,330 Pa (10 to 20 kgf/cm$^2$), at a flow rate of 1400 to 1800 liters/hr, at a concentration rate of 20:1. The inlet operation pressure was raised at a raising rate of 196,133 Pa/hr (2 kgf/cm$^2$·hr).

(1) In the case of the filtrate (1) which was passed through the 10 Em bag filter to remove the water-insoluble impurities, the permeation rate of the filtrate through the reverse osmosis membrane was 39 liters/hr·m$^2$ at the initial stage of the permeation procedure and 7 liters/hr·m$^2$ at the final stage at which the concentration ratio reached 20:1. Thus, during the permeation procedure, the reduction rate in the permeation rate of the filtrate was 80% or more.

(2) In the case of the filtrate (2) which was passed through the 10 μm bag filter after the treatment with the cationic synthetic organic polymeric flocculant (trademark: Acoflock) was completed, the permeation rate of the filtrate through the reverse osmosis membrane was 38 liters/hr·m$^2$ at the initial stage of the permeation procedure and 30 liters/hr·m$^2$ at the final stage at which the concentration ratio reached 20:1. Thus, during the permeation procedure, the reduction rate in permeation rate of the filtrate was about 21%.

(3) In the case of the filtrate (3) which was passed through the 10 μm bag filter after the treatment with the cationic natural organic polymeric flocculant (trademark: KIMITSUCHITOSAN L) was completed, the permeation rate of the filtrate through the reverse osmosis membrane was 36 liters/hr·m$^2$ at the initial stage of the permeation procedure and 28 liters/hr·m$^2$ at the final stage at which the concentrating ratio reached 20:1. Thus, the reduction rate in the permeation rate of the filtrate during the permeation procedure was 22%.

Figure 4:
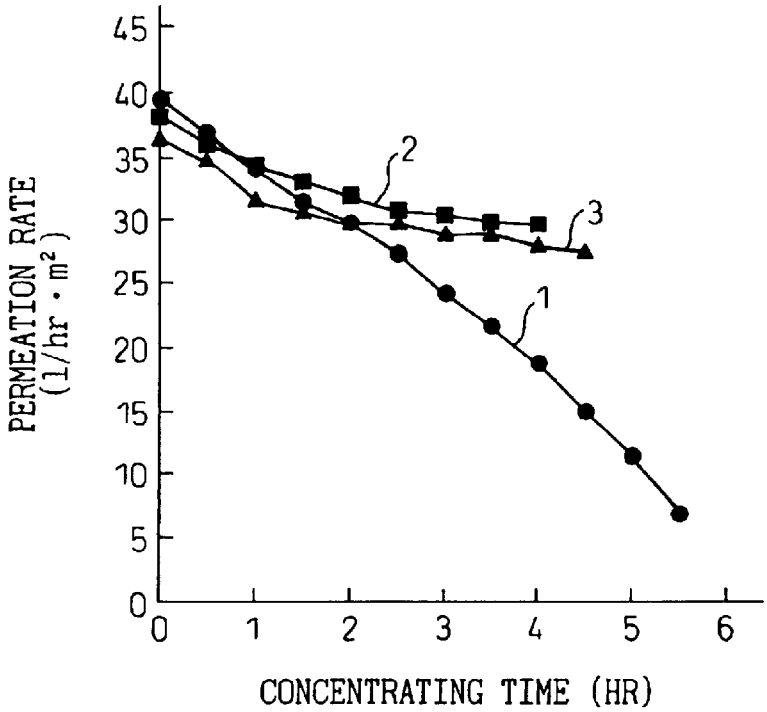
FIG. 4 is a graph showing relationship between the concentrating times and the permeation rates of the filtrates subjected to the reverse osmosis treatment in Example 10.

The changes in the permeation rates of the above-mentioned three types of filtrates are shown in FIG. 4. In FIG. 4, curve 1 shows a relationship between the permeation rate of the filtrate (1) and the concentrating (permeating) time, curve 2 shows a relationship between the permeation rate of the filtrate (2) and the concentrating (permeating) time, and curve 3 shows a relationship between the permeation rate of the filtrate (3) and the concentrating (permeating) time.

Before the permeation treatment, the filtrate (1) in an amount of 2000 liters contains 3400g of all the saccharides. The non-permeated fractions prepared from the filtrate (1), (2) and (3) in the concentrating ratio of 20:1 respectively had a total saccharide content of about 2700g per 100 liters, and the respective recovery yield was 80%.

Each of the non-permeated fractions was mixed with sulfuric acid to adjust the pH value thereof to 3.5, and then heated at a temperature of 121° C. for one hour.

The acid, heat treatment product was subjected to the ion chromatographic analysis.

Figure 5:
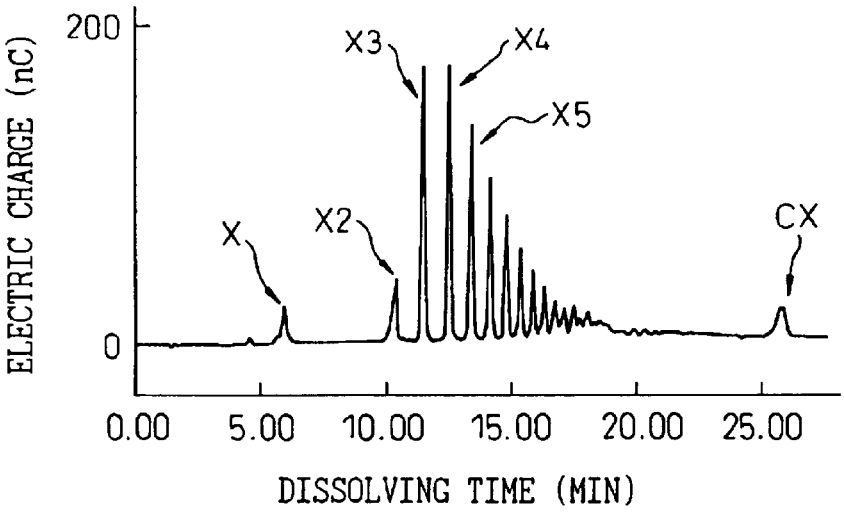
FIG. 5 is a chromatogram of a heat treatment product of the non-permeated fraction of Example 10.

The chromatogram of the non-permeated fraction obtained from the filtrate (2) is shown in FIG. 5. In FIG. 5, it was confirmed that the product of the acid, heat treatment contained xylose (x), xylose oligomers ($x_2$ to $x_5$ . . . ) and xylooligosaccharide complex (cx), in a high concentration.

Table 5 shows the total saccharide concentrations of the filtrates before and after various types of flocculants were added.

TABLE 5

| Filtrate | Flocculate formation | Total saccharide concentration (mg/liter) |
|---|---|---|
| Filtrate (1) before addition of flocculant | — | 1700 |
| Filtrate (2) mixed with cationic polymeric flocculant (trademark: ACOFLOCK C 492UH) | Flocculate was formed at 15 ppm flocculant | 1690 |
| Filtrate (2) mixed with non-ionic flocculant (trademark: ARONFLOCK N-101) | No flocculate was formed $(*)_1$ | 1680 |
| Filtrate (2) mixed with anionic flocculant (trademark: ARONFLOCK A-101) | No flocculate was formed $(*)_1$ | 1680 |

Note:
$(*)_1$ . . . Flocculant Content: 50 ppm

In this example, it was confirmed that the flocculant treatment applied to the filtrate before the permeation treatment did not affect the composition of the final xylooligosaccharide product.

What is claimed is:

1. A process for producing xylooligosaccharide from a lignocellulose pulp comprising the steps of:

enzyme-treating a linocellulose pulp with hemicellulase;

filtering the resultant reaction mixture delivered from the enzyme treatment step to separate a liquid fraction from the enzyme-treated pulp:

subjecting the liquid fraction delivered from the filtration step to a permeation treatment through a separation membrane to cause a non-permeated fraction containing xylooligosaccharide-lignin complex to be separated in an increased concentration thereof from a permeated fraction;

collecting the non-permeated fraction containing the xylooligosaccharide-lignin complex in the increased concentration;

adjusting the pH value of the collected non-permeated fraction to the range of from 1.5 to 5, by adding an acid to the collected non-permeated fraction to liberate xylooligosaccharide from the xylooligosaccharide-lignin complex; and recovering the liberated xylooligosaccharide.

2. The xylooligosaccharide-producing process as claimed in 1, wherein the lignocellulose pulp is selected from lignocellulose chemical pulps.

3. The xylooligosaccharide-producing process as claimed in claim 2, wherein the lignocellulose chemical pulps are selected from hardwood chemical kraft pulps.

4. The xylooligosaccharide-producing process as claimed in any one of claims 1 to 3, wherein before the enzyme treatment step, the lignocellulose pulps is bleached in an aqueous alkali solution with oxygen.

5. The xylooligosaccharide-producing process as claimed in claim 1, wherein in the enzyme treatment step, xylanase is employed as a hemicellulase.

6. The xylooligosaccharide-producing process as claimed in claim 1, wherein the xylooligosaccharide is collected from the non-permeated fraction containing the xylooligosaccharide-lignin complex by adjusting the pH value of the non-permeated fraction to 2 to 4, heating the pH-adjusted non-permeated fraction at a temperature of 100 to 170° C. to produce mono- to deca-mers of xylose from the xylooligosaccharide-lignin complex; and recovering the di- to deca-mers of xylose.

7. The xylooligosaccharide-producing process as claimed in claim 6, wherein before the recovering procedure, the heated non-permeated fraction is subjected to a membrane separation to collect a mixture of xylooligosaccharide with the di- to deca-mers of xylose from the heated non-permeated fraction.

8. The xylooligosaccharide-producing process as claimed in claim 7, wherein the collected mixture of the xylooligosaccharide with xylose di- to deca-mers is subjected to a treatment with an ion-exchange resin, to decolor and refine the xylooligosaccharide, before the separating and recovering step.

9. The xylooligosaccharide-producing process as claimed in claim 1, wherein the liquid fraction delivered from the filtration step is mixed with a flocculant selected from the group consisting of inorganic flocculants and polymeric flocculants; the resultant flocculate is removed from the liquid fraction by filtration; and the resultant flocculate-free filtrate is subjected to the permeation treatment through the separation membrane.

* * * * *